US006523945B2

(12) United States Patent
Powers et al.

(10) Patent No.: US 6,523,945 B2
(45) Date of Patent: Feb. 25, 2003

(54) BUBBLE GENERATOR FOR AN INK JET PRINT CARTRIDGE

(75) Inventors: James Harold Powers, Lexington, KY (US); Matthew Joe Russell, Stamping Ground, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 09/730,623

(22) Filed: Dec. 6, 2000

(65) Prior Publication Data

US 2002/0067397 A1 Jun. 6, 2002

(51) Int. Cl.[7] ..... B41J 2/175
(52) U.S. Cl. ..... 347/86
(58) Field of Search ..... 347/85, 86, 87, 347/92

(56) References Cited

U.S. PATENT DOCUMENTS

| | | | | |
|---|---|---|---|---|
| 3,930,260 A | | 12/1975 | Sicking | |
| 4,358,781 A | | 11/1982 | Yamamori et al. | |
| 4,791,438 A | | 12/1988 | Hanson et al. | |
| 4,806,032 A | | 2/1989 | Gragg et al. | |
| 4,992,802 A | | 2/1991 | Dion et al. | |
| 5,039,999 A | | 8/1991 | Winslow et al. | |
| 5,040,002 A | * | 8/1991 | Pollacek et al. | 347/87 |
| 5,153,162 A | | 10/1992 | Kurimoto et al. | |
| 5,363,130 A | | 11/1994 | Cowger et al. | |
| 5,400,573 A | | 3/1995 | Crystal et al. | |
| 5,409,134 A | | 4/1995 | Cowger et al. | |
| 5,505,339 A | | 4/1996 | Cowger et al. | |
| 5,526,030 A | | 6/1996 | Baldwin et al. | |
| 5,537,134 A | | 7/1996 | Baldwin et al. | |
| 5,600,358 A | | 2/1997 | Baldwin et al. | |
| 5,604,523 A | | 2/1997 | Tsukuda et al. | |
| 5,677,718 A | | 10/1997 | Crawford et al. | |
| 5,686,948 A | | 11/1997 | Crystal et al. | |
| 5,841,454 A | | 11/1998 | Hall et al. | |
| 5,917,523 A | | 6/1999 | Baldwin et al. | |
| 5,933,175 A | | 8/1999 | Stathem et al. | |
| 5,967,196 A | | 10/1999 | Moser | |
| 5,969,736 A | | 10/1999 | Field et al. | |
| 5,988,803 A | | 11/1999 | Komplin et al. | |
| 5,988,806 A | | 11/1999 | Hall et al. | |
| 6,158,848 A | * | 12/2000 | Liu | 347/85 |

* cited by examiner

*Primary Examiner*—Michael Nghiem
(74) *Attorney, Agent, or Firm*—Ronald K. Aust; Michael T. Sanderson

(57) ABSTRACT

An ink reservoir having a bubble generator includes an enclosure defining an interior space and an exterior space, the interior space being adapted for containing a supply of ink, the enclosure having a passage formed therein which permits fluid communication between the interior space and the exterior space, the passage including a surface, the passage defining a first aperture and a second aperture, wherein the second aperture is adjacent the interior space. A sphere is positioned in the passage and contacts a portion of the surface of the passage, the surface having a shape that permits ink to pass between the sphere and the surface. A membrane is positioned over the first aperture to retain the sphere in the passage, the membrane including at least one hole being sized to define a bubble admission pressure difference across a thickness of the membrane.

38 Claims, 4 Drawing Sheets

BUBBLE GENERATOR FOR AN INK JET PRINT CARTRIDGE

BACKGROUND OF THE INVENTION

1. Field of the Invention

The present invention relates to an ink jet print cartridge, and, more particularly, to a bubble generator for an ink jet print cartridge.

2. Description of the Related Art

A typical ink jet print cartridge includes an ink reservoir and a printhead for controllably jetting ink onto a printing medium. The printhead uses a thermal mechanism for ejecting drops. Such a thermal type printhead includes a thin-film resistor that is heated to cause sudden vaporization of a small portion of the ink. The rapid expansion of the ink vapor forces a small amount of ink through an associated one of a number of nozzles in the printhead. Another type of printhead uses a piezoelectric mechanism for ejecting drops.

Conventional drop-on-demand printheads are effective for ejecting or "pumping" ink drops from the ink reservoir, but require mechanisms for preventing ink from leaking through the printhead nozzles when the printhead is inactive. Accordingly, the fluid ink in the ink reservoir must be stored in a manner that provides a slight backpressure at the printhead to prevent ink leakage from the nozzles whenever the printhead is inactive. As used herein, the term "backpressure" means the partial vacuum within the ink reservoir that resists the flow of ink through the printhead nozzles. Backpressure is considered in the positive sense so that an increase in backpressure represents an increase in the partial vacuum. Accordingly, backpressure is measured in positive terms, such as water column height.

The backpressure at the printhead must be at all times strong enough for preventing ink leakage, and yet must not be so strong that the printhead is unable to overcome the backpressure to eject ink drops. Accordingly, the ink jet print cartridge must be designed to operate properly despite environmental changes that cause fluctuations in the backpressure. Such environmental changes can include, for example, changes in ambient atmospheric pressure such as that caused by changes in altitude. Accordingly, the level of backpressure within the ink jet print cartridge must be regulated during times of ambient pressure change.

In addition to environmental effects, the backpressure within an ink reservoir is also subjected to "operational effects." One significant operational effect occurs as the printhead is activated to eject ink drops. The depletion of ink from the ink reservoir increases (makes more negative) the reservoir backpressure. Without regulation of this backpressure increase, the ink jet printhead nozzles will eventually fail because the printhead will be unable to overcome the increased backpressure to eject ink drops.

One attempt to regulate ink reservoir backpressure in response to environmental changes and operational effects includes mechanisms commonly referred to as accumulators. One such mechanism provides an accumulator working volume that is sufficient for operating the nozzles notwithstanding extreme environmental changes and operational effects on the backpressure within the reservoir. The accumulator changes the overall volume of the reservoir, thereby to regulate backpressure level changes, so that the backpressure remains within an operating range that is suitable for preventing ink leakage while permitting the printhead to continue ejecting ink drops. For example, as the difference between ambient pressure and the backpressure within the nozzles decreases as a result of ambient air pressure drop, the accumulator moves to increase the reservoir volume, thereby to increase the backpressure to a level that prevents ink leakage. The accumulator also moves to decrease the ink reservoir volume whenever environmental changes or operational effects cause an increase in the backpressure. For example, the decreased reservoir volume attributable to accumulator movement reduces the backpressure to a level within the operating range, thereby permitting the printhead to continue ejecting ink. Even with an accumulator having a large working volume, there may be instances where the accumulator reaches its maximum working volume while an appreciable amount of ink remains in the reservoir. Continued printing to remove this remaining amount of ink could increase the backpressure by an amount outside the range for proper printhead operation, and in the event this occurs, printhead failure will also occur.

One approach used to solve this problem is to incorporate a "bubble generator" in the ink jet print cartridge. A typical bubble generator is an orifice formed in the ink reservoir to allow fluid communication between the interior of the reservoir and the ambient atmosphere. The orifice is sized such that the capillarity of the ink normally retains a small quantity of ink in the orifice as a liquid seal. The geometry of the orifice is such that when the backpressure approaches the limit of the operating range of the printhead, the backpressure overcomes the capillarity of the ink and the liquid seal is broken. As a result, ambient air "bubbles" enter into the ink reservoir to reduce the backpressure so that the printhead can continue to operate. When the backpressure drops, ink from the reservoir reenters the orifice and reinstates the liquid seal.

One such bubble generator consists of a tubular boss and a sphere mounted concentrically within the boss. The outside diameter of the sphere is smaller than the inside diameter of the boss to define an annular orifice. The sphere is maintained within the boss by a number of raised ribs formed around the interior of the boss. In this manner, the sphere can be press fit into the boss and maintained in position by the ribs. The raised ribs are sized to provide the necessary interference for a press fit to maintain the sphere within the boss and provide the necessary clearance from the inside wall of the boss. The sphere serves as a capillary member to maintain a quantity of ink within the boss. As a result, even when the pen is oriented such that the boss is not submerged in ink in the reservoir ink, a quantity of ink is trapped within the boss. Due to the curved surface of the sphere, the gap between the exterior surface of the sphere and the inner wall of the boss is smallest at the orifice and increases as the distance from the orifice increases. This geometry, coupled with the capillarity of the ink, constantly urges the trapped quantity of ink toward the orifice, the smallest portion of the gap, to provide a robust seal.

Another such bubble generator employs a sphere that is loosely placed in a cone shaped tubular boss having a number of raised ribs formed around the interior of the boss. The sphere is held in place in the ribbed cone by a flexible plastic film positioned across the outlet end of the cone.

Both of the aforementioned bubble generator designs rely on tight dimensional control of the ribs to achieve the desired bubble admission pressure. For example, as the surface tension of the ink contained in the ink reservoir decreases, the dimensions of the capillary channels formed between the ribs and the sphere must be reduced to readjust the bubble admission pressure to a desired value. As a further example, an increase in ink reservoir elevation with respect to the printhead nozzles increases the column height of the liquid supported by the reservoir backpressure, and this increase in column height can only be maintained by increasing the reservoir backpressure, i.e., by increasing bubble admission pressure. This as well results in the need to reduce the dimensions of the capillary channels formed between the ribs and the sphere. In either case, these changes translate into a reduced rib height, which can result in a rib height that is difficult to maintain under manufacturing conditions.

What is needed in the art is an improved bubble generator for an ink jet print cartridge that overcomes the shortcomings set forth above by being simple in design, easily modified, and comparatively easy to manufacture.

SUMMARY OF THE INVENTION

The present invention provides an improved bubble generator for an ink jet print cartridge.

The invention, in one form thereof, relates to an ink reservoir having a bubble generator. The ink reservoir includes an enclosure defining an interior space and an exterior space. The interior space is adapted for containing a supply of ink. The enclosure has a passage formed therein which permits fluid communication between the interior space and the exterior space. The passage includes a surface, and the passage defines a first aperture and a second aperture, wherein the second aperture is adjacent the interior space. A sphere is positioned in the passage and contacts a portion of the surface of the passage. The surface of the passage has a shape that permits ink to pass between the sphere and the surface. A membrane is positioned over the first aperture to retain the sphere in the passage. The membrane includes at least one hole being sized to define a bubble admission pressure difference across a thickness of the membrane.

An advantage of the present invention is that it is simple in design.

Another advantage is that it can be easily modified to change the bubble admission pressure.

Yet another advantage is that it is comparatively easy to manufacture.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, but such exemplifications are not to be construed as limiting the scope of the invention in any manner.

DETAILED DESCRIPTION OF THE INVENTION

Figure 1:
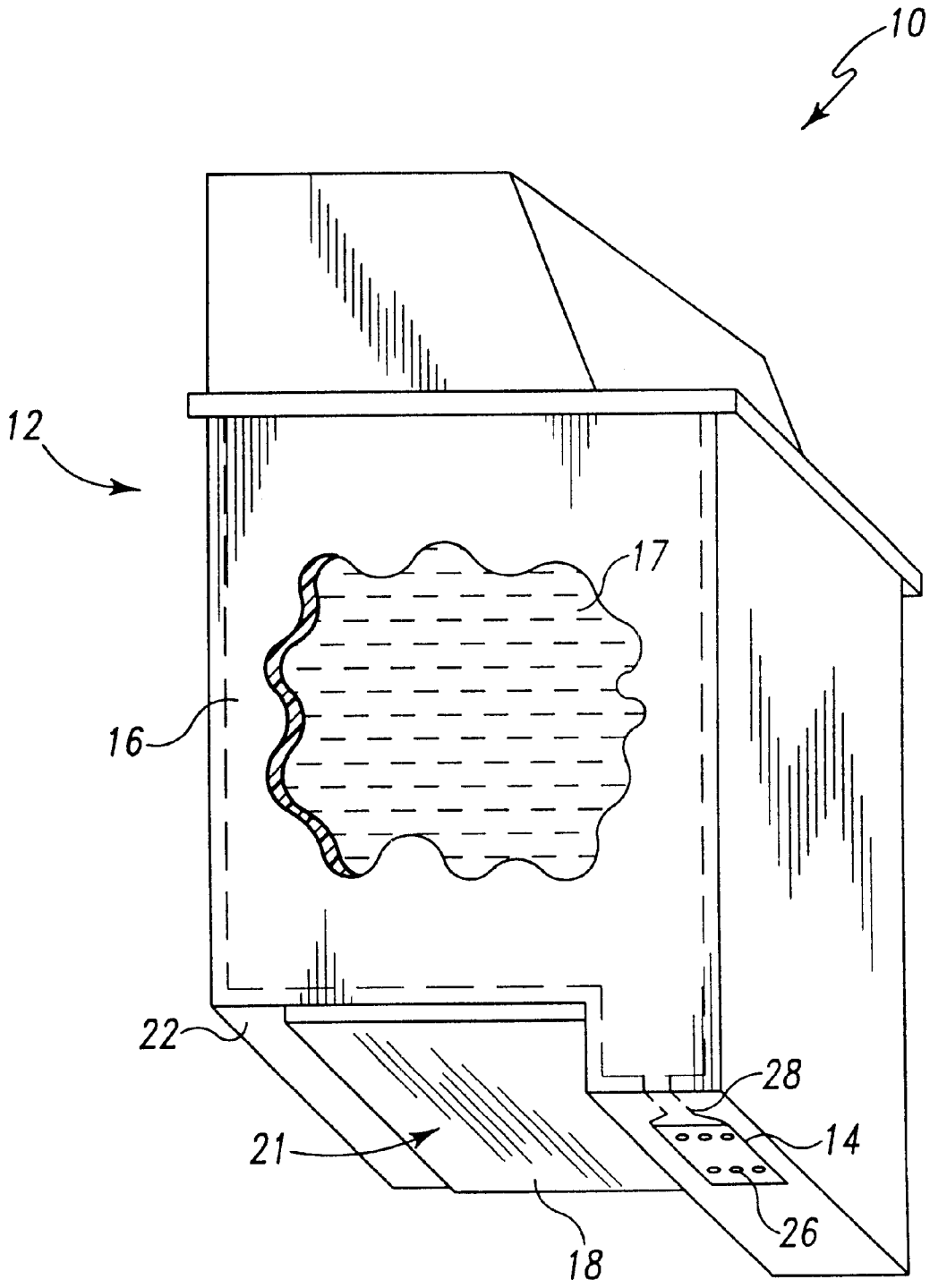
FIG. 1 is a perspective view of an ink jet print cartridge embodying the present invention, and having a portion broken away.

Referring now to the drawings and particularly to FIG. 1, there is shown an ink jet print cartridge 10 embodying the present invention.

Figure 2:
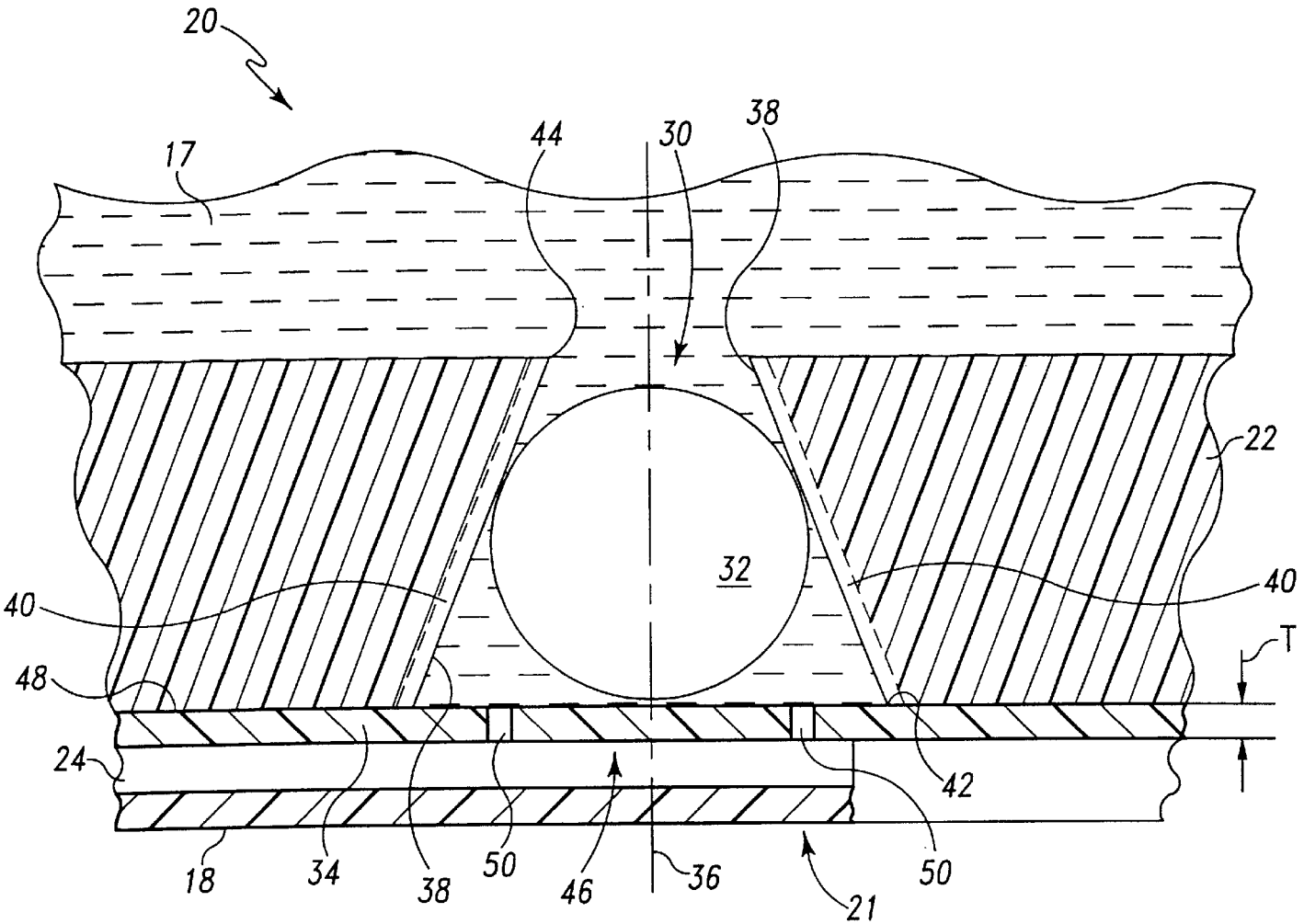
FIG. 2 is a side view in section of one embodiment of a bubble generator of the invention.

Ink jet print cartridge 10 includes an ink reservoir 12 and a printhead 14. Ink reservoir 12 includes an enclosure 16 that defines an interior space and an exterior space. The interior space of enclosure 16 is adapted for containing a supply of ink 17. The exterior space is the space outside enclosure 16, and is considered to be all space exposed to ambient air on a continuous basis. Ink reservoir 12 also has a plate 18 that is positioned to cover a bubble generator 20 of the invention (see FIG. 2) located at a first region 21 of ink reservoir 12. As shown in FIG. 2, plate 18 is spaced apart from a plate 22 of enclosure 16, and defines a vent path 24 that, for example, may have a serpentine shape, and permits the ambient atmosphere to act on bubble generator 20.

Printhead 14 has a plurality of ink jetting nozzles 26. Printhead 14 is connected by a conduit 28 (shown by dashed lines) to enclosure 16 so as to place ink jetting nozzles 26 in fluid communication with the interior space of enclosure 16, and thus, ink 17. Printhead 14 may be any type (such as for example, a thermal printhead) that is capable of controllably expelling ink from the supply of ink 17 contained in enclosure 16.

As shown in FIG. 2, bubble generator 20 includes a passage 30 formed in plate 22 of enclosure 16, a sphere 32 and a membrane 34.

Passage 30 is shown having an axis of symmetry 36 and includes a surface 38 having a shape which permits ink to pass between sphere 32 and surface 38. In the present embodiment, surface 38 is shaped to define a plurality of protrusions 40. As shown in FIG. 2, the cross-section of passage 30 decreases in a direction from the exterior space outside enclosure 16 toward the interior space of enclosure 16 of ink reservoir 12, and thus, has a shape in side view that resembles a truncated cone. Cone-shaped passage 30 defines a first aperture 42 facing the exterior space and a second aperture 44 adjacent the interior space of enclosure 16.

In one embodiment of the invention, each of the plurality of protrusions 40 forms an elongate rib that extends in a direction from first aperture 42 toward second aperture 44. Protrusions 40 are positioned to provide intermittent contact between surface 38 and sphere 32 within passage 30. The protrusions 40 need not extend for the full length of passage 30.

Passage 30 has a cross-section taken in a plane perpendicular to axis of symmetry 36 which may be substantially circular, i.e., circular but for the undulations provided by the plurality of protrusions 40. Alternatively, passage 30 may have a cross-section taken in the plane perpendicular to axis of symmetry 36 which may be non-circular, such as for example, a shape that is one polygonal, elliptical, star-shaped or irregular. In the cases where the passage is polygonal or elliptical, the protrusions may be eliminated, since these shapes would also result in the intermittent contact of the surface of passage 30 with sphere 32.

Sphere 32 is formed from a durable material, such as for example, metal, glass or plastic, and is held in contact with surface 38 by membrane 34. Membrane 34 is made from a non-porous elastic material, such as a polymer film.

As shown in the embodiment of FIG. 2, passage 30 and sphere 32 are sized such that sphere 32 does not protrude from an exterior end 46 of passage 30. Membrane 34 is attached to a surface 48 of plate 22, and remains in a planar state. However, since sphere 32 extends to the plane of surface 48, membrane 34 holds sphere 32 in contact with a portion of surface 38 of passage 30. Membrane 34 includes a plurality of holes, collectively identified as 50 and individually identified as 50*a*–50*h*, that are located so that at least one of the holes 50 is not completely covered by sphere 32, regardless of the actual placement of membrane 34 in relation to passage 30 and sphere 32. As used herein, the term "not completely covered" includes both the situation where a hole is partially covered by sphere 32 and the situation where a hole is not covered at all by sphere 32. The plurality of holes 50 are sized to define a bubble admission pressure difference across a thickness T of membrane 34.

Figure 3:
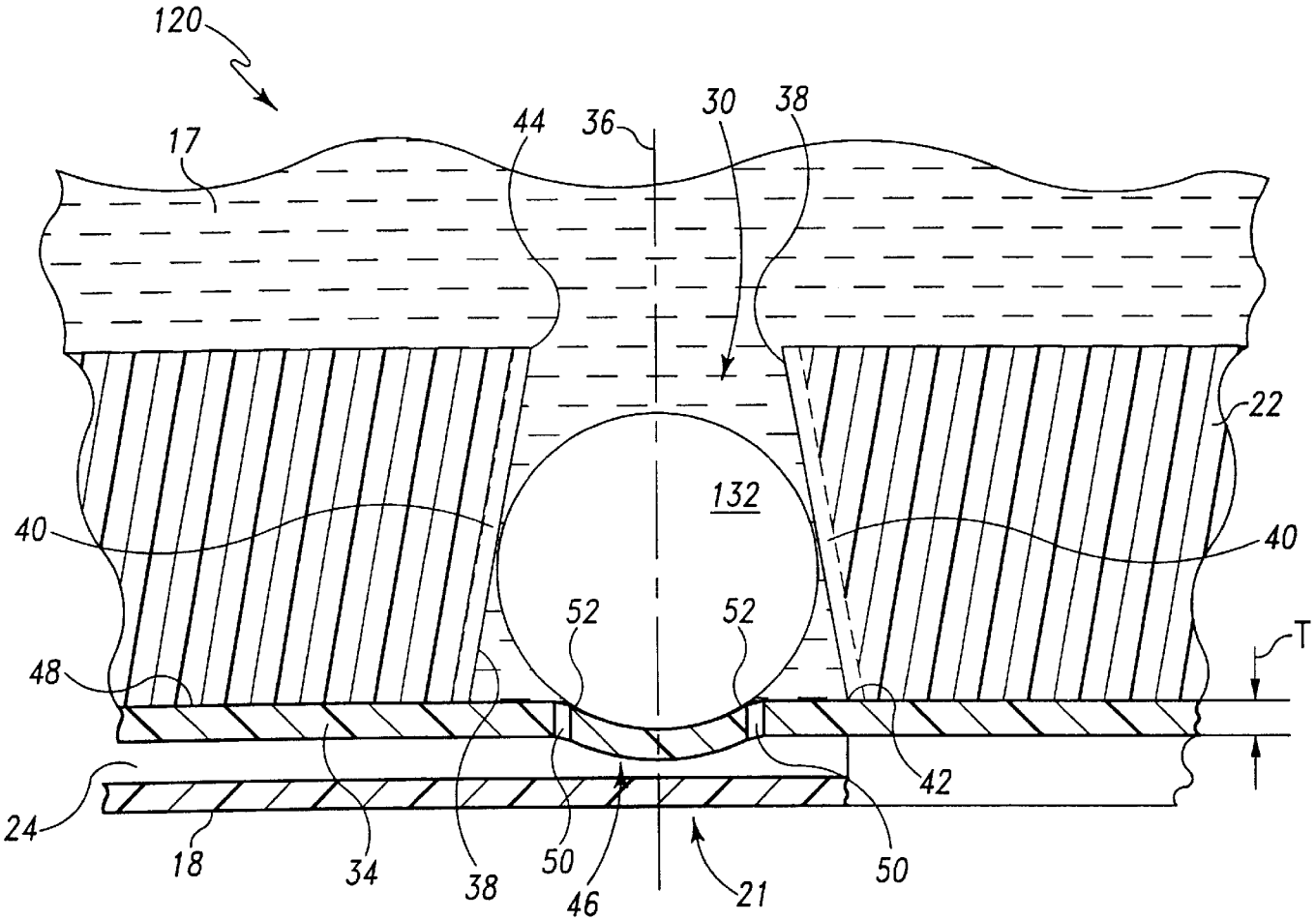
FIG. 3 is a side view in section of another embodiment of a bubble generator of the invention.

As shown in the embodiment of FIG. 3, a bubble generator 120 includes passage 30 and a sphere 132 sized such that sphere 132 does protrude from exterior end 46 of passage 30. Sphere 132 is similar to sphere 32 in all respects in the present embodiment, other than size. Membrane 34 is attached to surface 48 of plate 22 and is deformed by the contact with sphere 132, since sphere 132 extends beyond the plane of surface 48. Accordingly, membrane 34 constrains sphere 132 in contact with a portion of surface 38 of passage 30. The contact between sphere 132 and membrane 34 defines a circular contact region 52 on membrane 34 having a diameter D1 (see FIG. 4A). The plurality of holes 50 of membrane 34 are located so that at least one of the holes, for example 50*a*, lies outside circular contact region 52, so that at least one of the holes is not completely covered by sphere 132, regardless of the actual placement of membrane 34 in relation to passage 30 and sphere 132.

Figure 4A:
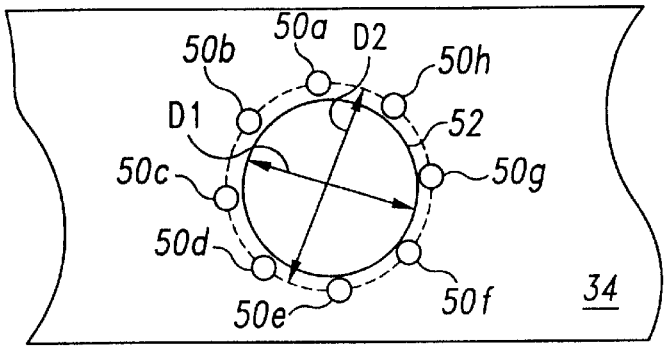
FIGS. 4A and 4B illustrate a hole pattern for use in a bubble generator of the invention.
Figure 4B:
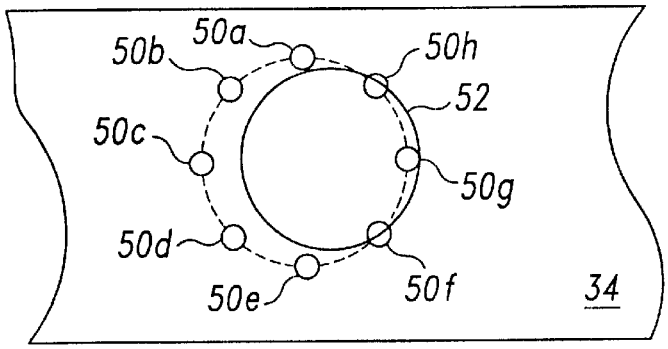

FIGS. 4A and 4B illustrate a formation of the plurality of holes 50 in membrane 34 in a circular pattern. The circular pattern has a diameter D2 selected such that at least one of said plurality of holes is not completely covered by sphere 132, regardless of the actual placement of membrane 34 in relation to passage 30 and sphere 132. As shown in FIG. 4B, even if membrane 34 is mis-aligned with respect to sphere 132, and in turn passage 30, at least a portion of holes 50, e.g. holes 50*a*, 50*b*, 50*c*, 50*d*, 50*e* and 50*f* as shown, are available to define a bubble admission pressure difference across the thickness T of membrane 34. In order to achieve this result, the circle having the diameter D2 is defined to pass through each of the holes 50, and is chosen to be equal to or greater than the diameter D1 of circular contact region 52.

Figure 5:
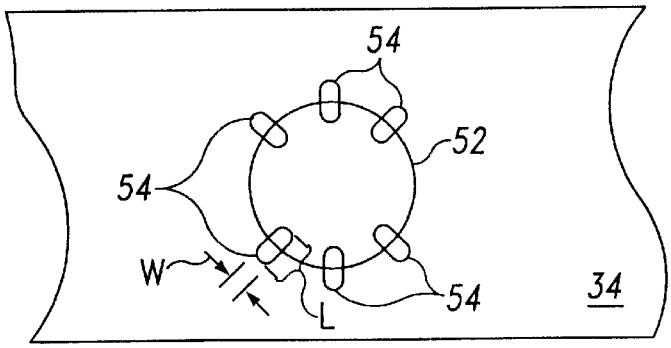
FIG. 5 illustrates another hole pattern for use in a bubble generator of the invention.

As illustrated in FIG. 5, the holes in membrane 34 need not be circular, but rather, may be formed by other shapes. FIG. 5 shows a plurality of radial slots 54 having a length L and a width W, and wherein the actual dimensions of slots 54 may vary from one to another.

In practicing the invention, it is to be understood that the pattern of the plurality of holes in the membrane need not be circular, so long as the pattern ensures that at least one of the holes is not completely covered by the sphere. In addition, the pattern of holes may be randomly placed, and so long as the distance between the interiors of at least two of the randomly placed holes is chosen to be equal to or greater than the diameter D1 of circular contact region 52, at least one of the holes will not be completely covered by the sphere. Where membrane 34 is a polymer film, the plurality of holes may be formed, for example, by a process of chemical etching, mechanical punching, drilling or laser ablation.

In the present invention, the bubble generator is configured with a passage and sphere arrangement having enhanced dimensional control of the capillary channel between the surface of the passage and the sphere, the capillary channel permitting ink to pass therethrough. In the embodiments of the invention that include protrusions in the passage, the protrusion height, which in part defines the size of the capillary channel, is less critical than in prior designs, since the height of the protrusions no longer controls the bubble admission pressure difference.

Also, it is to be noted that the invention is functional without plate 18. However, plate 18 also serves to protect membrane 34 from external forces which could damage membrane 34 and render the bubble generators 20, 120 ineffective.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink reservoir, comprising:

an enclosure defining an interior space and an exterior space, said interior space being adapted for containing a supply of ink, said enclosure having a cone-shaped passage formed therein which permits fluid communication between said interior space and said exterior space, said cone-shaped passage including a surface, said cone-shaped passage defining a first aperture and a second aperture, said second aperture being adjacent said interior space;

a sphere positioned in said cone-shaped passage and contacting a portion of said surface of said cone-shaped passage, said surface having a shape that permits ink to pass between said sphere and said surface; and a membrane positioned over said first aperture to retain said sphere in said cone-shaped passage, said membrane including at least one hole being sized to define a bubble admission pressure difference across a thickness of said membrane.

2. The ink reservoir of claim 1, wherein said sphere protrudes from an exterior end of said cone-shaped passage, such that said membrane is deformed by contact with said sphere.

3. The ink reservoir of claim 2, wherein said membrane is a polymer film.

4. The ink reservoir of claim 2, wherein said contact between said sphere and said membrane defines a circular contact region on said membrane.

5. The ink reservoir of claim 4, wherein said at least one hole in said membrane is located outside said circular contact region.

6. The ink reservoir of claim 4, wherein said at least one hole forms a radial slot having a length and a width.

7. The ink reservoir of claim 4, wherein said at least one hole comprises a plurality of holes formed in a circular pattern having a diameter selected such that at least one of said plurality of holes is not completely covered by said sphere.

8. The ink reservoir of claim 7, wherein at least one of said plurality of holes forms a radial slot having a length and a width.

9. The ink reservoir of claim 1, wherein said surface of said cone-shaped passage defines a plurality of elongate ribs extending in a direction from said first aperture toward said second aperture.

10. The ink reservoir of claim 1, wherein said at least one hole comprises a plurality of holes formed in a circular pattern having a diameter selected such that at least one of said plurality of holes is not completely covered by said sphere.

11. The ink reservoir of claim 1, wherein said at least one hole comprises a plurality of holes formed in a pattern selected such that at least one of said plurality of holes is not covered by said sphere.

12. The ink reservoir of claim 1, wherein said at least one hole is formed as a radial slot having a length and a width.

13. The ink reservoir of claim 1, wherein said membrane is a polymer film.

14. The ink reservoir of claim 13, wherein said at least one hole is formed in said polymer film by a process of one of etching, punching, drilling and laser ablation.

15. The ink reservoir of claim 1, wherein a cross-section of said cone-shaped passage has a non-circular shape.

16. The ink reservoir of claim 15, wherein said non-circular shape is one of polygonal, elliptical, star-shaped and irregular.

17. An ink reservoir, comprising:

an enclosure defining an interior space and an exterior space, said interior space being adapted for containing a supply of ink, said enclosure having a first region, said first region having a passage formed therein, said passage including a surface, said passage defining a first aperture and a second aperture, said second aperture being adjacent said interior space, said first aperture having a first diameter and said second aperture having a second diameter;

a sphere having third diameter smaller than said first diameter and larger than said second diameter, said sphere being positioned in said passage; and a membrane positioned over said first aperture to retain said sphere in said passage, said membrane including at least one hole being sized to define a bubble admission pressure difference across a thickness of said membrane.

18. The ink reservoir of claim 17, wherein said sphere protrudes from an exterior end of said passage, such that said membrane is deformed by contact with said sphere.

19. The ink reservoir of claim 18, wherein said membrane is a polymer film.

20. The ink reservoir of claim 18, wherein said contact between said sphere and said membrane defines a circular contact region on said membrane, wherein said at least one hole in said membrane is located outside said circular contact region.

21. The ink reservoir of claim 17, wherein said surface defines a plurality of ribs extending in a direction from said first aperture toward said second aperture.

22. The ink reservoir of claim 17, wherein said at least one hole forms a radial slot having a length and a width.

23. The ink reservoir of claim 17, wherein said at least one hole comprises a plurality of holes formed in a circular pattern having a diameter selected such that at least one of said plurality of holes is not completely covered by said sphere.

24. An ink jet print cartridge, comprising:

an enclosure defining an interior space and an exterior space, said interior space being adapted for containing a supply of ink, said enclosure having a first region, said first region having a cone-shaped passage formed therein, said cone-shaped passage including a surface defining a plurality of protrusions, said cone-shaped passage defining a first aperture and a second aperture, said second aperture being adjacent said interior space;

a printhead connected by a conduit to said enclosure to be in fluid communication with said interior space;

a sphere positioned in said cone-shaped passage and contacting said protrusions; and a membrane positioned over said first aperture to retain said sphere in said cone-shaped passage, said membrane including at least one hole being sized to define a bubble admission pressure difference across a thickness of said membrane.

25. The ink jet print cartridge of claim 24, wherein said sphere protrudes from an exterior end of said cone-shaped passage, such that said membrane is deformed by contact with said sphere.

26. The ink jet print cartridge of claim 25, wherein said membrane is a polymer film.

27. The ink jet print cartridge of claim 25, wherein said contact between said sphere and said membrane defines a circular contact region on said membrane, wherein said at least one hole in said membrane is located outside said circular contact region.

28. The ink jet print cartridge of claim 24, wherein said at least one hole forms a slot having a length and a width.

29. The ink jet print cartridge of claim 24, wherein said at least one hole comprises a plurality of holes formed in a circular pattern having a diameter selected such that at least one of said plurality of holes is not covered by said sphere.

30. The ink jet print cartridge of claim 24, wherein each of said plurality of protrusions comprise an elongate rib extending in a direction from said first aperture toward said second aperture.

31. The ink jet print cartridge of claim 24, further comprising a plate spaced apart from and positioned to cover said membrane.

32. An ink reservoir, comprising:

an enclosure defining an interior space and an exterior space, said interior space being adapted for containing a supply of ink, said enclosure having a cone-shaped passage formed therein which permits fluid communication between said interior space and said exterior space, said cone-shaped passage including a surface, said cone-shaped passage defining a first aperture and a second aperture, said second aperture being adjacent said interior space;

a sphere having a surface positioned in said cone-shaped passage and contacting a portion of said surface of said cone-shaped passage, said surface having a shape that permits ink to pass between said sphere and said surface; and a membrane positioned over said first aperture to retain said sphere in said cone-shaped passage, said membrane including at least one hole partially covered by said surface of said sphere.

33. The ink reservoir of claim 32, wherein said at least one hole further comprises a plurality of holes.

34. The ink reservoir of claim 33, wherein at least two of said plurality of holes is at least partially covered by said sphere.

35. The ink reservoir of claim 32, wherein said at least one hole is round.

36. The ink reservoir of claim 32, wherein said at least one hole has an oval shape.

37. The ink reservoir of claim 32, wherein said at least one hole forms a radial slot having a length and a width.

38. The ink reservoir of claim 32, wherein said at least one hole is sized to define a bubble admission pressure difference across a thickness of said membrane.

* * * * *